United States Patent [19]

Hanke

[11] 4,039,368

[45] Aug. 2, 1977

[54] APPARATUS FOR SPLICING TOGETHER THE ENDS OF A PAIR OF STRIPS OF FILM OR TAPE

[75] Inventor: Rudolph Martin Hanke, Monheim, Germany

[73] Assignee: Hama Hamaphot K.G., Hanke & Thomas, Monheim, Germany

[21] Appl. No.: 705,412

[22] Filed: July 15, 1976

Related U.S. Application Data

[63] Continuation-in-part of Ser. No. 513,591, Oct. 10, 1974.

[51] Int. Cl.[2] ..... B31F 5/00

[52] U.S. Cl. ..... 156/506

[58] Field of Search ..... 156/505, 506, 510

[56] References Cited

U.S. PATENT DOCUMENTS

| | | | |
|---|---|---|---|
| 3,716,444 | 2/1973 | Hanke | 156/510 |
| 3,833,447 | 9/1974 | Gustafson | 156/505 |
| 3,904,472 | 9/1975 | Glaus | 156/505 |

*Primary Examiner*—Douglas J. Drummond
*Attorney, Agent, or Firm*—Ross, Ross & Flavin

[57] ABSTRACT

A film or tape splicer for splicing together the ends of a pair of to-be-joined strips disposed in end-to-end adjacency with a tab part of a three-part splicing tab, being folded over and adhered to each of the opposite faces of the to-be-joined strips, one part of the tab being adhered to one side of each of the adjacent strips and the other part of the tab being folded over the aligned edges at one side of the strips and adhered to the other side of each of the strips.

5 Claims, 15 Drawing Figures

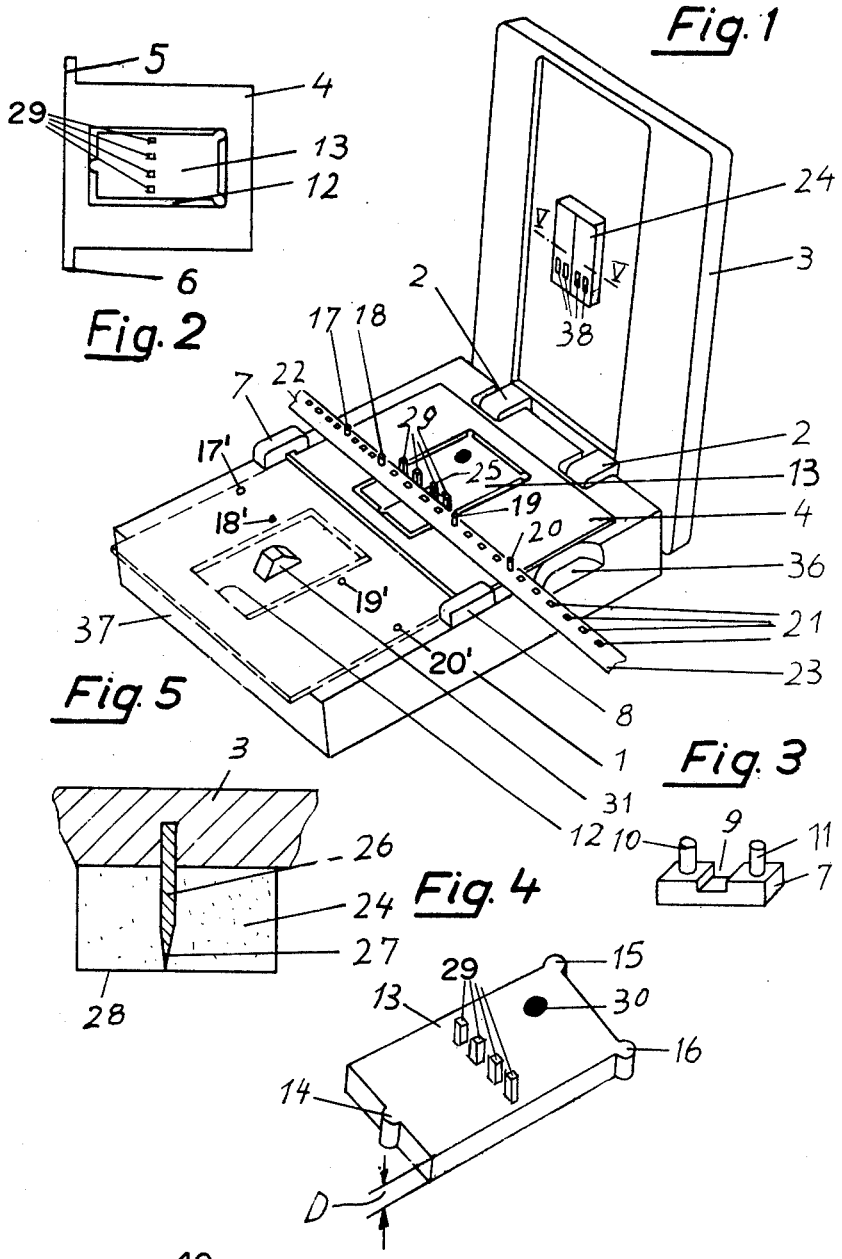
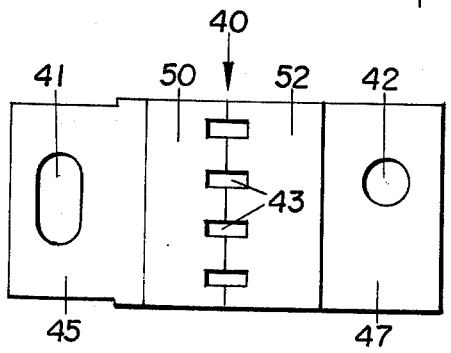
Fig. 6
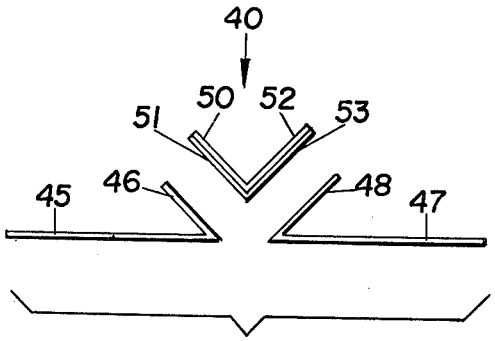
Fig. 7

APPARATUS FOR SPLICING TOGETHER THE ENDS OF A PAIR OF STRIPS OF FILM OR TAPE

This invention is a continuation-in-part of application, Ser. No. 513,591. filed by me on Oct. 10, 1974.

It is directed to the splicing apparatus for use in splicing together the ends of two strips of say, recording tapes, cinematograph films, or the like, and to a splicing tab which is employed therewith and to a method of using the splicing tab in connection with the strip-splicing apparatus.

The splicing apparatus includes a base and a cutting blade-carrying lid hinged thereto. A prominence or upstanding anvil for supporting the strips is formed upon the top planar surface of the base and engages within a window of a flap, which flap is hingedly mounted so as to be swingable relative to and on the base. The flap serves to support the strip ends to be joined and to invert them by the flap being swung between a first rearward position and a second forward position.

The strip ends may need to be first cut accurately at a predetermined junction point by a closing of the hinged lid, and are then connected together by means of a tab which is applied firstly with one part thereof to one side and, after swinging over of the flap, then with another part thereof to the other side of the adjacent strip ends.

The tab is an adhesively coated element of a three-part splicing tab, which splicing tab also includes a first and a second release paper, the papers, being in seriatim pulled away from the adhesively coated tab so as to allow half parts of the tab to be adhesively secured first to one pair of faces of the to-be-joined strip ends and then folded over and adhesively secured to the other pair of faces thereof.

The splicing point has a precision such as has been achieved heretofore only by means of devices which are technically more expensive. The invention primarily provides a highly accurate splicing apparatus, the individual parts of which do not need to be adjusted, once assembled.

The three part splicing tab coacts with the flap, the flap being provided with pins or teeth which, for positioning the strips, engage into the perforations in the strips. The splicing tab is made up of three basic parts—a first release paper or peelable protective cover, a second release paper or peelable protective cover, and the adhesively coated splicing element per se called simply the tab, which is placed upon the adjacent strip ends to join same together, first by being adhered to one side of each of the adjacent strip ends and then secured by being adhered to the other side of each of the adjacent strip ends.

In the drawings:

FIG. 1 is a view, in perspective, of a preferred embodiment of the splicing apparatus of the invention, the lid being shown in open position;

FIG. 2 is a detached plan view, on a reduced scale, of the flap and anvil of the FIG. 1 apparatus;

FIG. 3 is a perspective view showing one of the bearing blocks of the FIG. 1 apparatus prior to its being fitted into position;

FIG. 4 is an enlarged perspective view of the anvil of the base of the FIG. 1 apparatus;

FIG. 5 is an enlarged sectional view on line V—V of FIG. 1;

FIG. 6 is an enlarged view in top plan of the three-part splicing tab employed with the FIG. 1 apparatus;

FIG. 7 is an enlarged exploded view in side elevation showing the three basic parts of the FIG. 6 splicing tab and dramatising their general relationship to each other;

Figure 8:
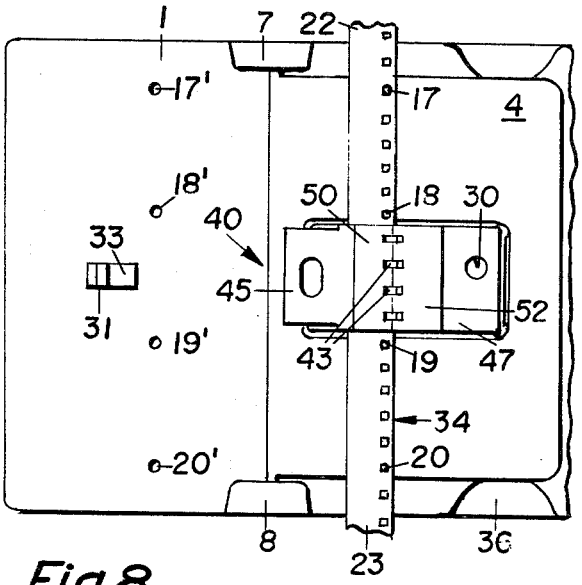
Figure 9:
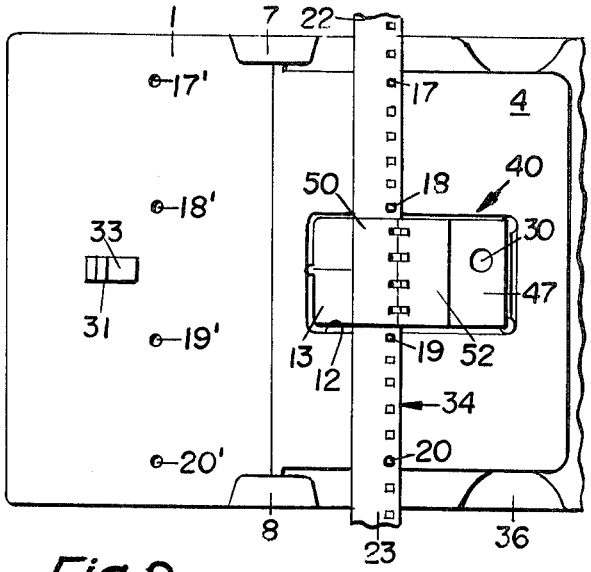
Figure 10:
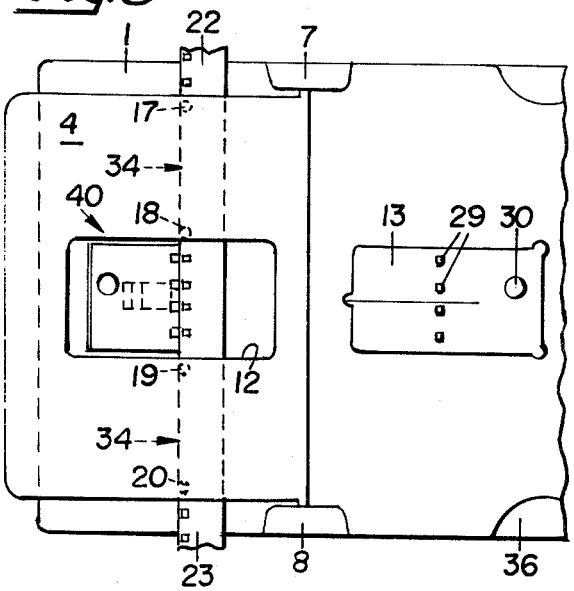
Figure 11:
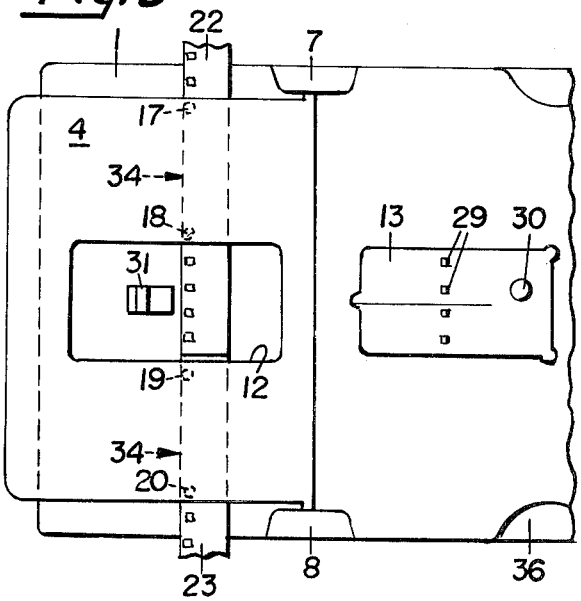
Figure 12:
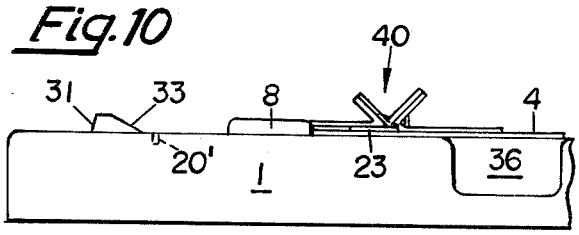
Figure 13:
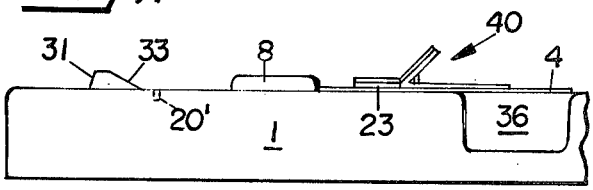
Figure 14:
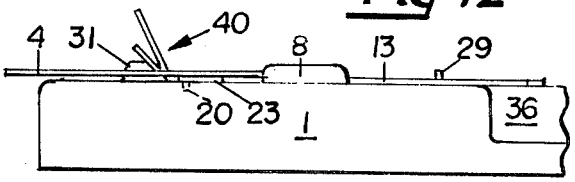
Figure 15:
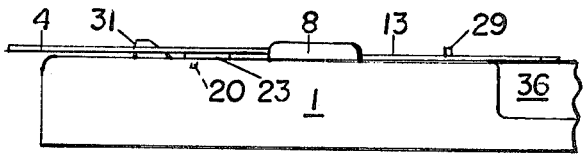

FIG. 8 is an enlarged fragmentary view in top plan showing the splicing tab in operating position upon the anvil of the FIG. 1 apparatus and on top of the to-be-joined strips, with the flap in the first rearward position, the front of the apparatus being understood to be leftward in this and all subsequent views for purposes of orientation, with the splicing tab being ready to be worked for the splicing operation;

FIG. 9 is a view generally similar to FIG. 8 showing the first release paper of the splicing tab having been peeled away therefrom so as to expose the adhesively coated first half of the tab which has now been laid down upon the uper faces of the ends of the adjacent strips;

FIG. 10 is a view generally similar to FIG. 8 showing the flap having been swung to its second forward position carrying the adjacent strips and the remaining parts of the three-part splicing tab therewith, with the second-release paper of the splicing tab being supported upwardly in an inclined easy-to-grab position on the cam;

FIG. 11 is a view generally similar to FIG. 8 showing the second release paper having been peeled away from the splicing tab so as to expose the adhesively coated second half of the tab which has now been folded over and down upon the lower faces of the ends of the adjacent strips; and FIGS. 12–15 are fragmentary views in side elevation of the showings in FIGS. 8–11 respectively.

The apparatus is for splicing together, in an end-to-end manner, a pair of strip ends 22, 23, as shown in FIG. 1. A base 1 is generally rectangular configuration and has a complementa! rectangular lid 3 hinged to base 1 as by conventional hinges 2.

As shown in FIG. 2, a platelike flap 4 of generally rectangular configuration, has tenons 5 and 6 which extend outwardly from its opposite side edges. Flap 4 is swingably mounted on base 1 by means of tenons 5 and 6 engaging into bearing blocks 7 and 8. One such bearing block 7 is shown in FIG. 3.

Tensons 5 and 6 may be formed integral with flap 4 so as each to have a generally rectangular cross-section.

Each of bearing blocks 7 and 8 will have a bearing recess 9 which is open towards base 1 when in situ, which recess will be in cross-section, the shape of a rectangular groove. See FIG. 3. Each bearing block 7 and 8 will be provided, on each side of its respective bearing recess 9, with cylindrical pins 10 and 11 which are insertable in a friction fit manner, into suitably provided pin holes in base 1.

In installing flap 4 relative to base 1, bearing block 7 is first fitted to base 1. Flap 4 is then inserted by its tenon 5 into the bearing recess 9 of bearing block 7. Bearing block 8 is next fastened to base 1, pin 6 engaging in bearing recess 9 of bearing block 8.

Thus it is observed that the bearing blocks are fastened in a clamped manner on the base and have bearing recesses into which tenons of the flap loosely engage.

A rectangular window 12 is provided in flap 4.

In a first or rearwardly-swung position of flap 4, shown in FIG. 1 in full lines, a rectangular countermember or anvil or prominence 13 upstanding upwardly from the upper planar surface of base 1 engages into this window. The thickness D (see FIG. 4) of counter-member or anvil 13, whose upper side is parallel to the plane of the base, is approximately equal to the thickness of flap 4.

Formed on anvil 13 are three outwardly projecting centering lobes 14, 15 and 16 (see FIG. 4) which serve to constrain flap 4 whereby it assumes a fixed location when it is swung to its first rearward position. Lobes 14, 15, 16 are so configured that window 12 snugly fits thereover. Consequently, flap 4, tenons 5 and 6 of which are mounted with a play in respective bearing recesses 9, is consistently brought into one and the same position when flap 4 occupies the first rearward position, shown in full lines in FIG. 1.

Located on flap 4 along a line transverse to the longitudinal extent of the apparatus are teeth of pins 17, 18, 19 and 20, which teeth or pins project upwardly and perforations 21 in the two strip ends 22 and 23 desired to be spliced together engage thereupon.

Mounted on lid 3 is a pressure pad 24 formed of a resiliently elastic material such as cellular rubber. Same is so disposed that, upon the closing of lid 3 upon base 1, the pad presses onto the adjacent strip ends to ensure that the strips lie flat on the top surface or counter-surface provided by anvil 13 at the cutting point indentified by the line shown as 25 on the anvil in FIG. 1.

Upon strip ends 22, 23 being engaged by pad 24, a blade 26, embedded in the pad, projects outwardly of the pad, at least to the extent of its own cutting edge 27, past the lower edge 28 of the pad (FIG. 5) so as to sever the strip ends at the cutting point 25.

Mounted on anvil 13 so as to be disposed parallel to the line along which pins or teeth 17 to 20 are arranged, are upwardly projecting pins or prongs 29 for engagement thereon of a splicing tab 40. See FIGS. 1 and 4. So that the splicing tab is applied in a positionally correct manner, a marking spot 30 is provided on anvil 13 for alignment with a counter-marking aperture 42 on the splicing tab to be referred to later.

When the flap is swung into its second forward position, the flap pins 17, 18, 19 and 20 are receivable in respective flap pin receiving openings 17', 18', 19' and 20' in the base.

Base 1 is further provided with an upwardly projecting cam 31. As flap 4 is swung from its first rearward position (shown in FIG. 1 in full lines) into its second forward position (shown in broken lines in FIG. 1) cam 31 projects up into and through window 12 of flap 4 and serves as an abutment for engagement thereagainst of the splicing tab. The cam is arranged in such a way that its inclined surface 33 faces toward the edges 34 of strips 22 and 23, when they are swung forwardly with the flap as it is shifted from first to second position.

As will be seen shortly, not only is a part of the splicing tab supported by the cam, but also that second part of the tab which is required to be folded over the upper side of the strips comes into engagement with the cam. Consequently, after drawing-off the second protective paper strip 47, the freely upwardly extending part of the tab can be conveniently gripped from below and applied onto the upper side of the strips 22 and 23.

As seen in FIG. 1, gripping notches 36, which permit the flap 4 to be gripped comfortably from below when in its first position for swinging it over, may be provided in base 1. Comparable gripping notches are unnecessary at the front edge 37, because flap 4, when in its second position slightly overlaps base 1 and can therefore be engaged comfortably.

So that the pressure pad 24 can be applied in an unhindered manner to the strip ends 22, 23, holes 38 in the pad, into which the pins 29 enter when the hinged lid 3 is closed, may be provided.

As the use of the apparatus is hereinafter described, the construction of the splicing tab will first be made clear in connection therewith.

The three-part splicing tab 40 comprises a first protective strip 45 having a smaller first tab protector 46 bent over upon itself and a second protective strip 47 having a smaller second tab protector 48 bent over upon itself, the strips 45 and 47 being disposed in confrontation with each other, and a tab consisting of a first half 50 and a second half 52 hingedly connected thereto with the lower surfaces of the first and second half parts 50 and 52 of the tab being conditioned with adhesive coatings 51 and 53 respectively, which coatings are of the release type so that when and as the first and second tab protectors 46 and 48 are peeled away from the respective half parts by pulling on the respective protective strips 45 and 47, the adhesive coating remains on the first and second half parts 50 and 52.

In use, presupposing that a cutting of the end of each of strips 22, 23 is first indicated, the inner end of one strip, say strip 22, with its dull coated side facing downwardly, is first placed upon pin 18 of flap 4 so that it overlaps cutting line 25 by at last one frame. The strip is then pulled gently leftwardly and is placed additionally upon pin 17.

The inner end of strip 23, again with the dull coated side facing downwardly, is then placed upon pin 19 so that it also overlaps cutting line 25 by at least one frame. This strip is then pulled gently rightwardly and is placed additionally upon pin 20.

In this way, the strips are properly positioned upon their respective flap pins. For the cutting, lid 3 is now brought into its closed position relative to base 1 and is pressed firmly downwardly wherefore both of the strip ends are simultaneously cut.

Lid 3 is then lifted and the strip fragments are removed.

The splicing tab is then placed on pins 29 of anvl 13 with first protective strip 45 being uppermost and pointing toward the operator. The splicing tab is provided with four aligned openings 43 and these are adpated to be received over the four pins 29.

The first protective strip 45 is pulled gently horizontally toward cam 31 and toward the front of the apparatus and is fixedly held in this position by the placement of the finger thereupon rearwardly of pins 29.

As the first protective strip 45 is pulled forwardly, the thereby released first half tab 50 is pressed downwardly onto strips, with the first half tab adhering to the upper faces of the strips due to the adhesive coating 51.

Flap 4 is now swung over into its second forward position with the strips and splicing tape carried therewith, and inverting the flap, strips and splicing tape in the process.

Due to cam 31, the second protective strip 47 is now elevated so as to facilitate its removal by pulling same rearwardly away from the operator.

At the same time, the second half tab 52 is pressed upon the strips and is adhered thereto due to the adhesive coating 53.

The flap and strips are then swung back to the original first position where the spliced strips may be then released from their pins 17, 18, 19 and 20.

I claim:

1. A film or tape splicer and cooperant splicing tab for splicing together the ends of a pair of to-be-joined strips comprising:

a base, a flap for holding the strips in end-to-end adjacency, means allowing swinging of the flap relative to the base between a rearward position of holding the strips in a face-up first position and a forward position of holding the strips in a face-down second position, a three-part splicing tabe including first and second release limbs and hinged together first and second half portions of an adhesively-coated tab, the first and second release links being peelable from the respective first and second half portions, first guide means for holding the splicing tab in position relative to the flap and the strips held thereby and facilitating the peeling of the first release limb away from the first half portion of the tab for the adhering of the first half portion of the tab on the exposed adjacent ends of the faces of the strips with the flap in rearward position, second guide means for facilitating the peeling of the second release limb away from the second half portion of the tab for adhering of the second half portion of the tab on the exposed adjacent ends of the backs of the strips with the flap in forward position, a lid mounted on the base for pivotal movements between opened-non-cutting and closed-cutting positions, a cutter carrried by the lid, and a counter-member carried by the base and providing a counter-surface for cooperation with the cutter in the closed cutting position of the lid, the flap having an opening therethrough the counter-member being constituted by an anvil positoned on the base member for accommodation within the opening in the first position of the flap.

2. Equipment as set forth in claim 1, the flap in first position being accurately located relative to the cutter by the location of the anvil in the opening.

3. Apparatus as set forth in claim 1 in which pins are provided on the flap for the strips to be received by and held by the flap by perforations thereon engaging with the pins.

4. Apparatus as set forth in claim 3, the flap having aligned tenons projecting respectively from adjacent corners thereof, the means mounting the flap on the base including for each tenon a respective bearing block having a respective bearing recess in which the respective tenon engages loosely.

5. Apparatus as set forth in claim 4, wherein the bearing recess is substantially rectangular.

* * * * *